United States Patent [19]

Morita

[11] Patent Number: 5,010,622

[45] Date of Patent: Apr. 30, 1991

[54] DOOR STOPPER

[76] Inventor: Tamao Morita, 47-1 Arakawa 6-chome Arakawa-ku, Tokyo, Japan

[21] Appl. No.: 544,098

[22] Filed: Jun. 26, 1990

Related U.S. Application Data

[63] Continuation of Ser. No. 295,677, Jan. 11, 1989, abandoned.

[30] Foreign Application Priority Data

| | | | |
|---|---|---|---|
| Apr. 28, 1988 | [JP] | Japan | 63-103834 |
| Apr. 28, 1988 | [JP] | Japan | 63-103835 |
| Apr. 28, 1988 | [JP] | Japan | 63-103836 |
| Apr. 28, 1988 | [JP] | Japan | 63-103837 |

[51] Int. Cl.[5] ..... E05C 17/56

[52] U.S. Cl. ..... 16/85; 16/82; 292/251.5; 292/DIG. 19; 267/139

[58] Field of Search ..... 16/82, 83, 85, 86 R; 292/251.5, DIG. 19; 296/207; 267/139, 170

[56] References Cited

U.S. PATENT DOCUMENTS

| | | | |
|---|---|---|---|
| 1,126,836 | 2/1915 | Newton | 16/85 |
| 2,449,687 | 9/1948 | Brinda | 16/85 |
| 2,472,397 | 6/1949 | Bennett | 16/85 |
| 2,479,597 | 8/1949 | Anton | 16/85 |
| 2,761,718 | 9/1956 | Tool | 16/85 |
| 3,025,559 | 3/1962 | Basinger | 16/85 |
| 3,244,443 | 4/1966 | Rodgers | 16/82 |
| 3,701,557 | 10/1972 | Centofante | 292/251.5 |
| 4,505,502 | 3/1985 | Tomita | 16/82 |
| 4,669,766 | 6/1987 | Hanchett, Jr. et al. | 292/251.5 |
| 4,700,436 | 10/1987 | Morita | 292/251.5 |

FOREIGN PATENT DOCUMENTS

| | | | |
|---|---|---|---|
| 453595 | 12/1948 | Canada | 16/82 |
| 1180547 | 12/1958 | France | 292/251.5 |
| 2095321 | 9/1982 | United Kingdom | 292/251.5 |
| 2099492 | 12/1982 | United Kingdom | 292/251.5 |

*Primary Examiner*—Richard K. Seidel
*Assistant Examiner*—James Miner
*Attorney, Agent, or Firm*—Pennie & Edmonds

[57] ABSTRACT

The present invention relates to improvements in door stoppers for keeping doors open. More particularly, the invention offers door stoppers which facilitate opening/closing of the door by the attraction of a permanent magnet, prevent damage to the attracting member by causing the attracting member and the attracted member comprising such a door stopper to gradually attract each other by a buffer action, and make either one of the attracting member or the attracted member swingable so as to enable secure and stable attraction.

11 Claims, 8 Drawing Sheets

DOOR STOPPER

Figure 1:
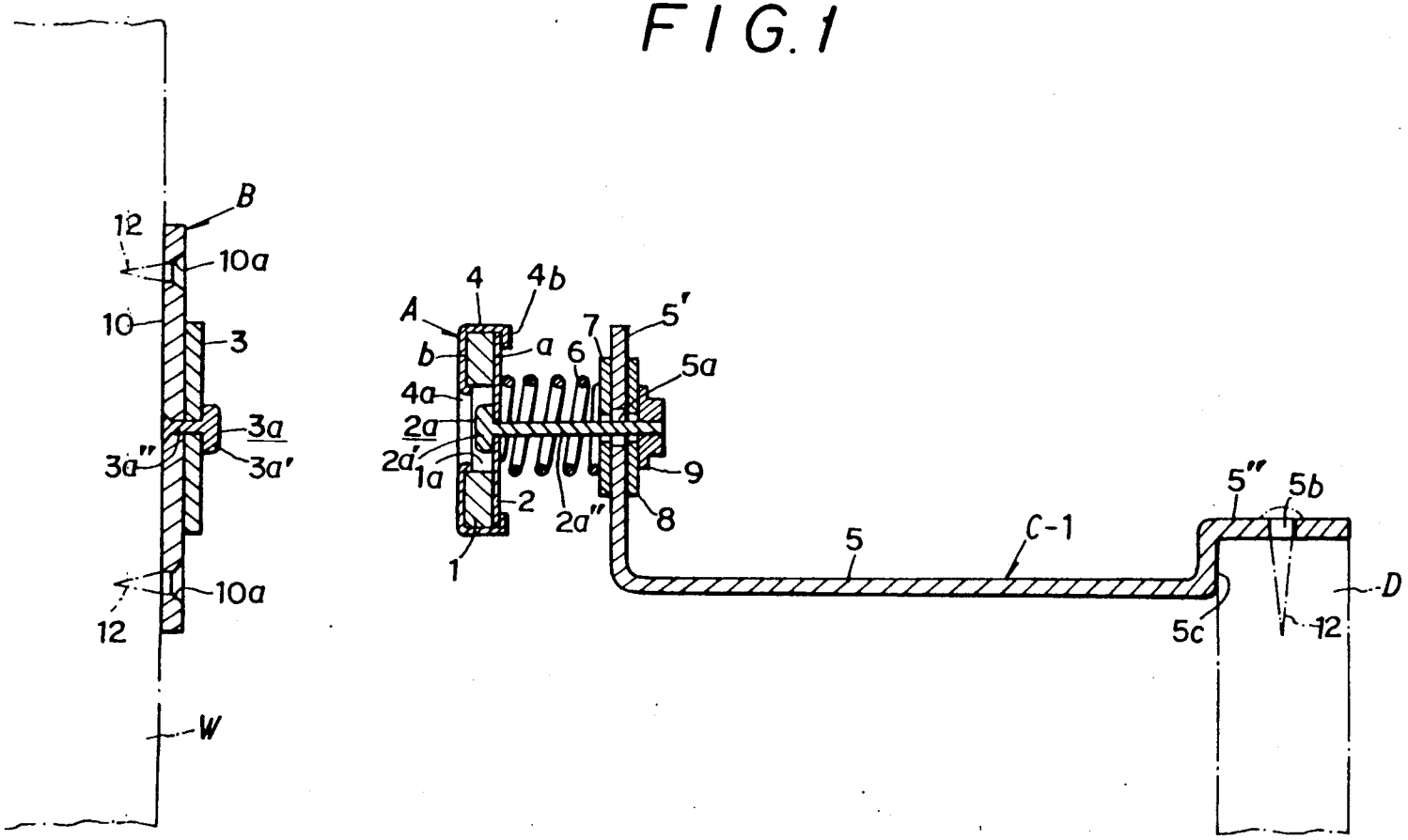

This is a continuation of application Ser. No. 07/295,677, filed Jan. 11, 1989, now abandoned.

This invention relates to an improvement in door stoppers which are used to keep doors open by the force of a permanent magnet. It relates further to an improvement in door stoppers in which either one of the attraction member or the attracted member is made swingable so that the stopper can be readily attracted and yet cannot be easily released from the attracted state. This invention further relates to an improvement in door stoppers which allows sufficient buffer action so that the door will not contact the stopper violently as the door is attracted and stopped by the stopper. The invention also relates to an improvement in door stoppers which can close the door by merely pulling the open door to thereby release the engagement by the stopper.

BACKGROUND OF THE INVENTION

Doors are generally closed after they are opened. However, it is often necessary to keep a door open depending on the situation. It is more practical to keep open the door of a passage where many people come and go so as to avoid frequently opening and closing the door each time a person passes through. By keeping such a door open, the door can be protected from damage to the hinges as there is applied no load thereon. It is also possible to prevent noises of opening/closing the door if the door is in a passage with frequent comings and goings, and to keep the environment quiet.

It is further advantageous to keep open a door for a delivery entrance. The delivery person is freed from the trouble of putting the goods down on the floor, opening the door, and then lifting the goods again to pass through the door. This putting down and lifting of a load to open the door becomes all the more necessary if the delivery person is carrying a huge or heavy load.

It is also advantageous to keep a door open where ventilation of a room is called for. Such a door may be a door to an entrance hall, to a kitchen, or to another room. Adjoining rooms can be connected and turned into a larger room by keeping the doors open to such rooms, and children playing in the next room can be watched.

In order to achieve such states as mentioned above, a wedge shaped stopper is often placed between the lower edge of the open door and the floor, or a string is tied to the door knob and stretched to keep the door open. Another measure generally taken to keep a door open is to provide a hook on the floor of which the direction can be changed into different directions and to engage said hook with a ring mounted on the door surface.

All these methods are defective in that the wedge shaped stopper must be placed or taken out, the string must be tied or un-tied, or the hook engaged or disengaged every time the door is to be kept open. In order to avoid such troublesome steps, a door is merely left open and no wedge-like stoppers, strings or hooks are used. However, such a door often becomes shut by the wind, emitting loud noise.

A need for a means for keeping a door open by a simple manipulation was thus keenly felt. The door stopper according to the present invention was conceived in view of situations as outlined above.

OBJECTS AND SUMMARY OF THE INVENTION

A primary object of this invention is to offer a door stopper which can securely maintain the door in an opened state by merely opening and letting the door stand open using the attraction of a permanent magnet.

Another object of the present invention is to offer a door stopper which prevents the open door from becoming shut by the wind and emitting loud noise.

A further object of this invention is to offer a door stopper which offers a buffer action for the attraction of the magnet and prevents damage to the door as it bangs on the wall.

Still another object of this invention is to offer a door stopper which follows the movement of one of the stopper members by making another of the stopper members capable of swinging.

Yet another object of this invention is to offer a door stopper which can keep the attraction of the door stopper in a stable state by making either one of the attraction members swingable.

A further object of this invention is to offer a door stopper which can close the open door by forcibly pulling the door toward the person closing the door.

The present invention has the above mentioned objects, and further objects of the present invention will become clear from the descriptions given below and those in the scope of Patent claims.

Figure 2:
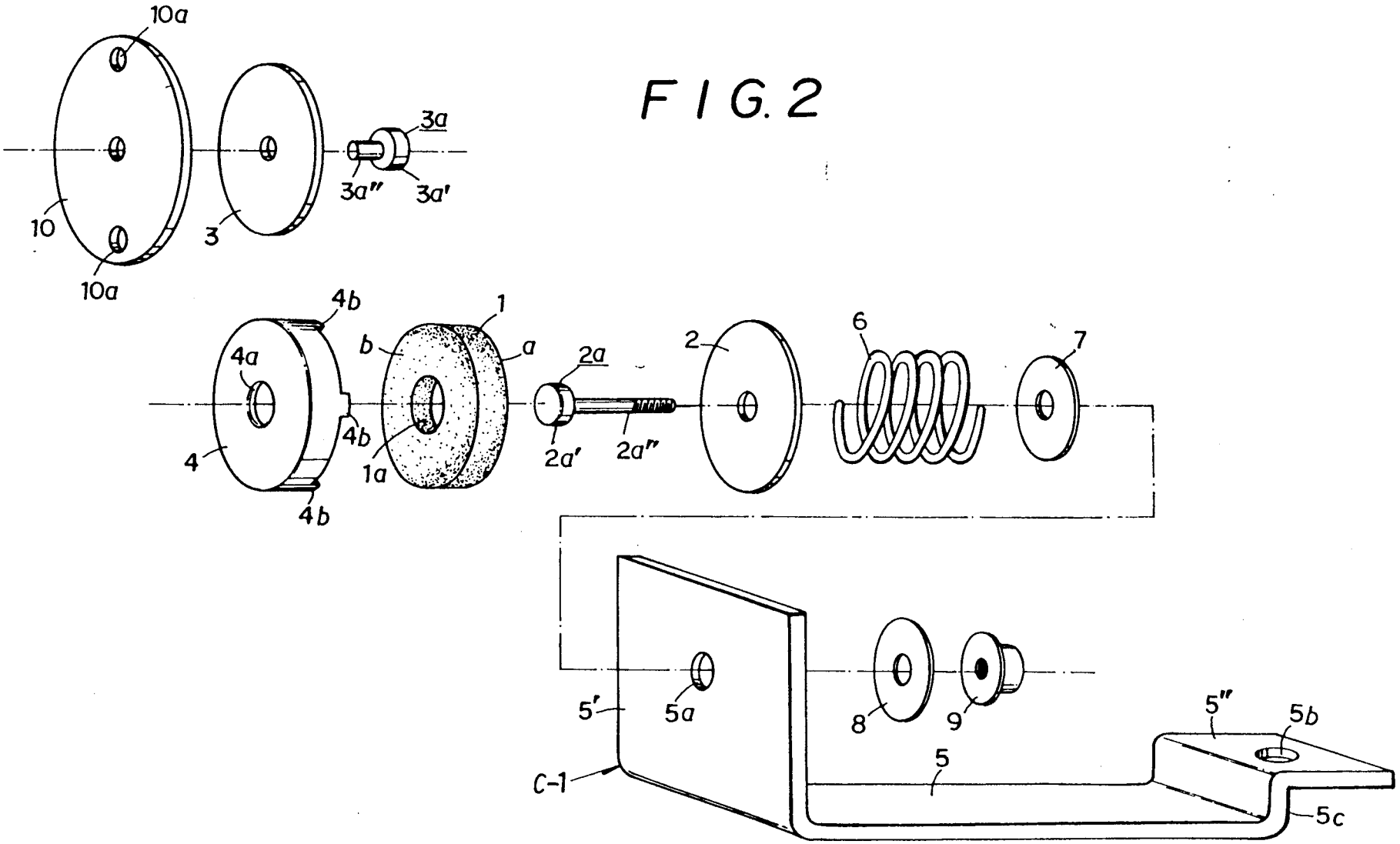
Figure 3:
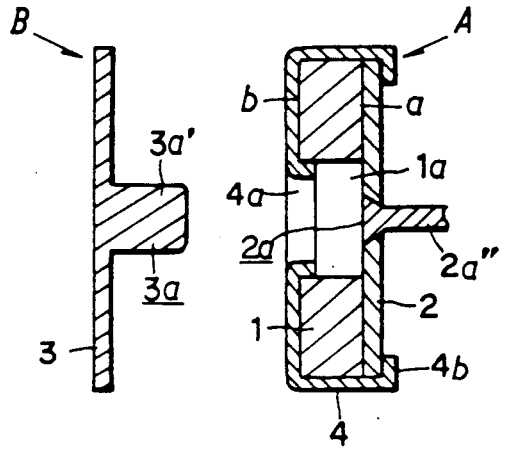
Figure 4:
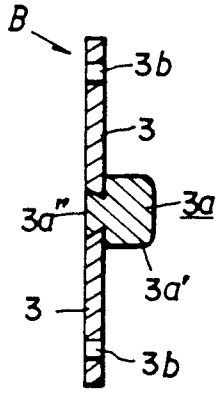
Figure 5:
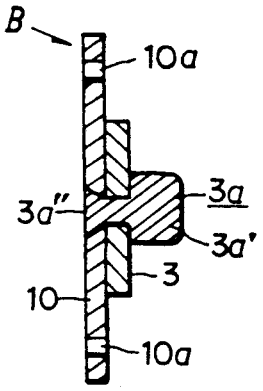
Figure 6:
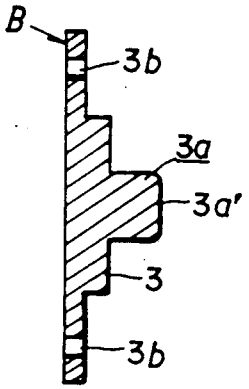
Figure 13:
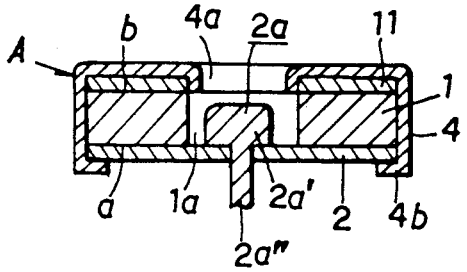
Figure 14:
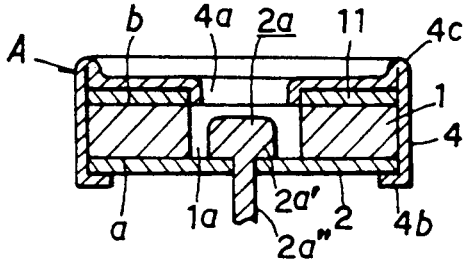
Figure 15:
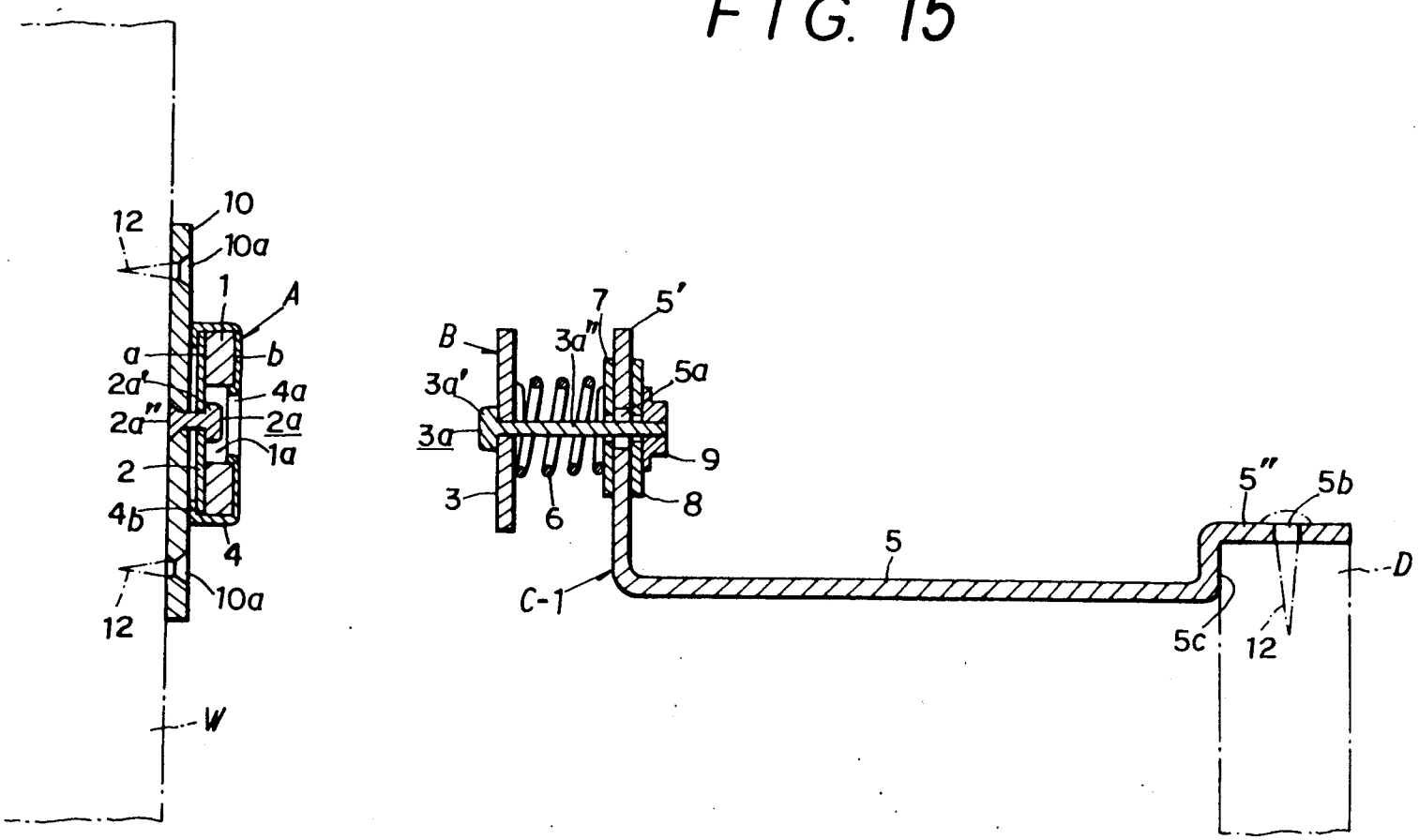
Figure 16:
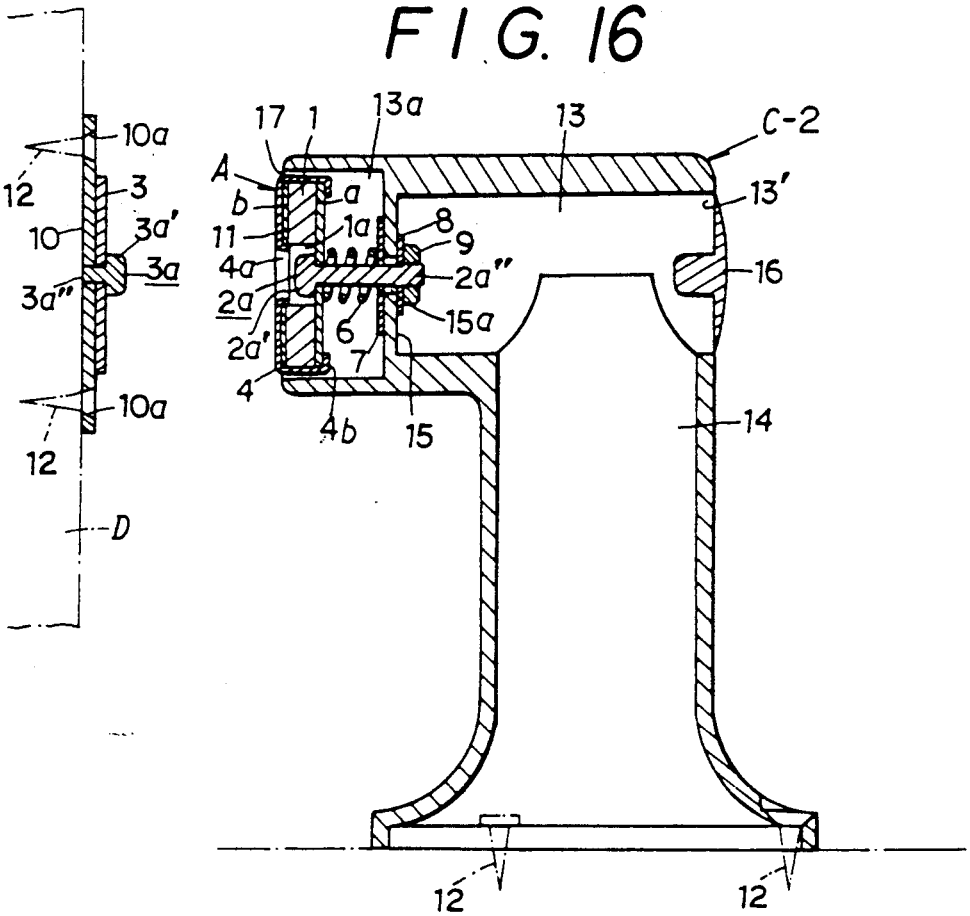
Figure 17:
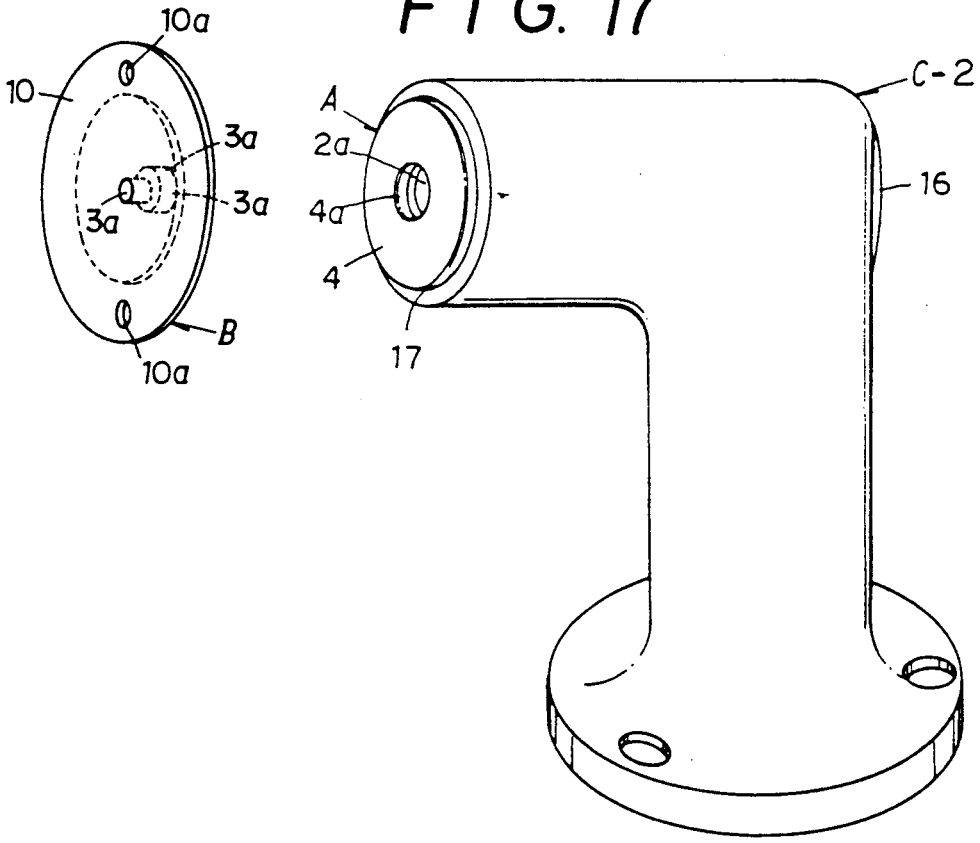
Figure 18:
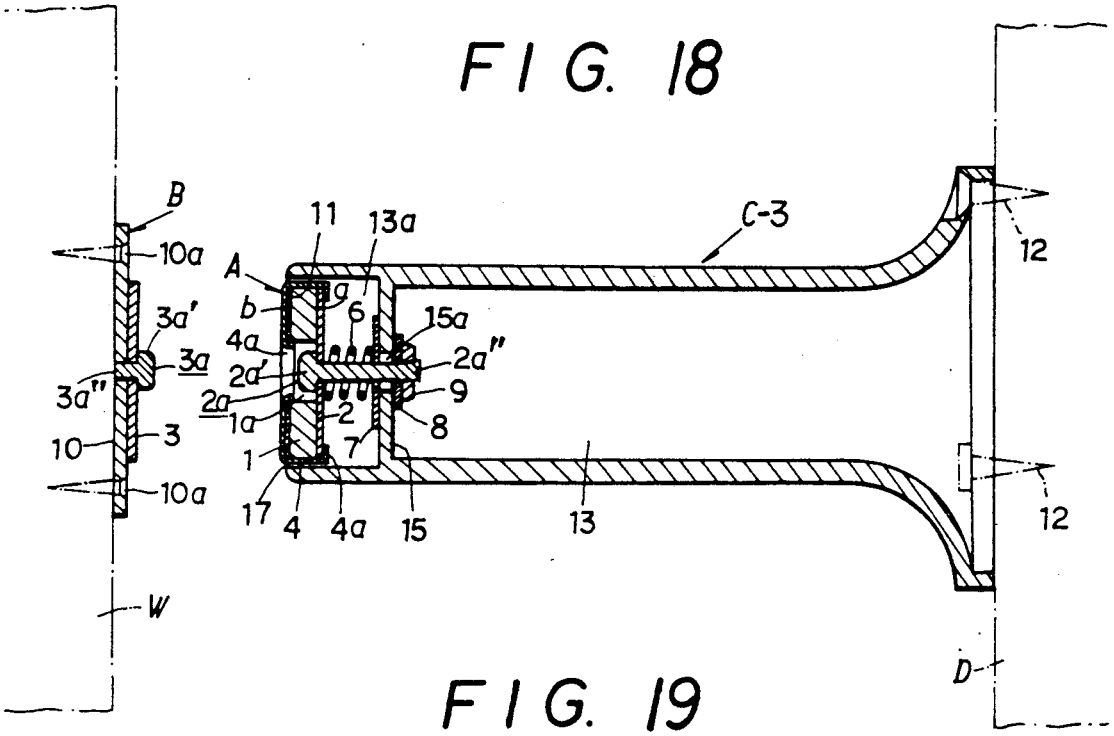
Figure 19:
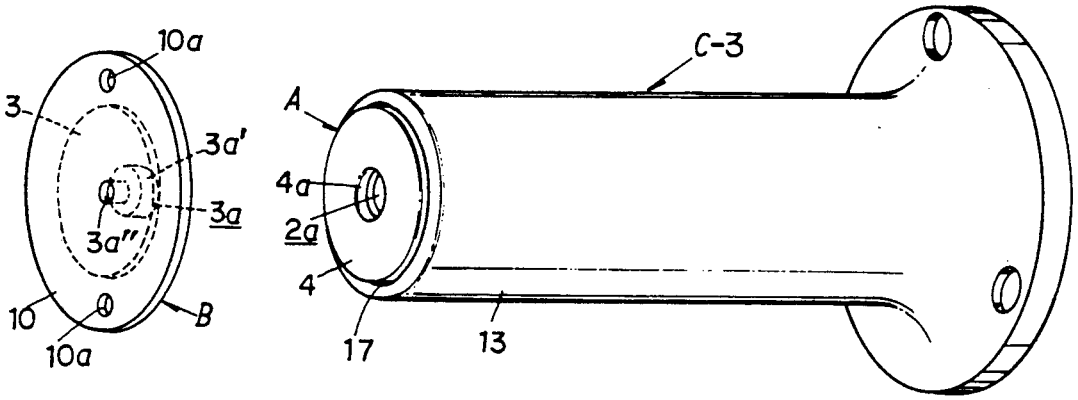
Figure 20:
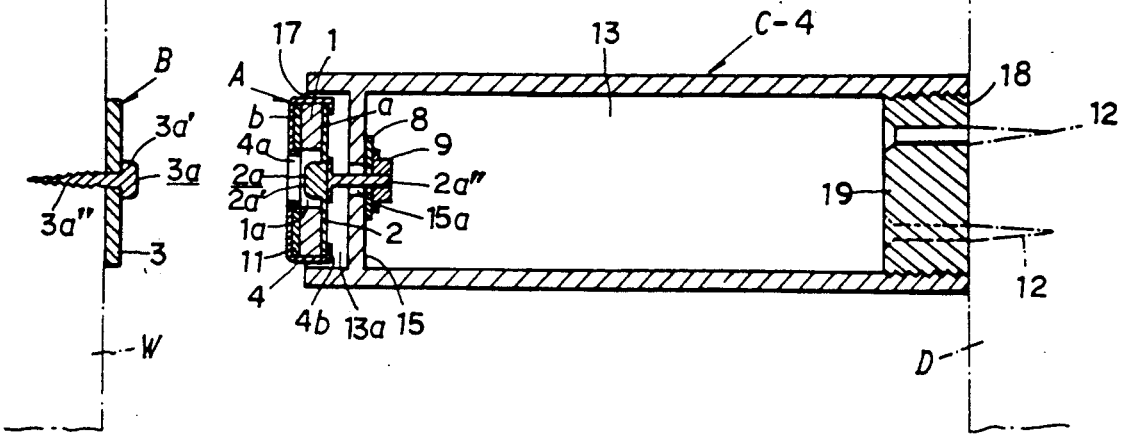
Figure 21:
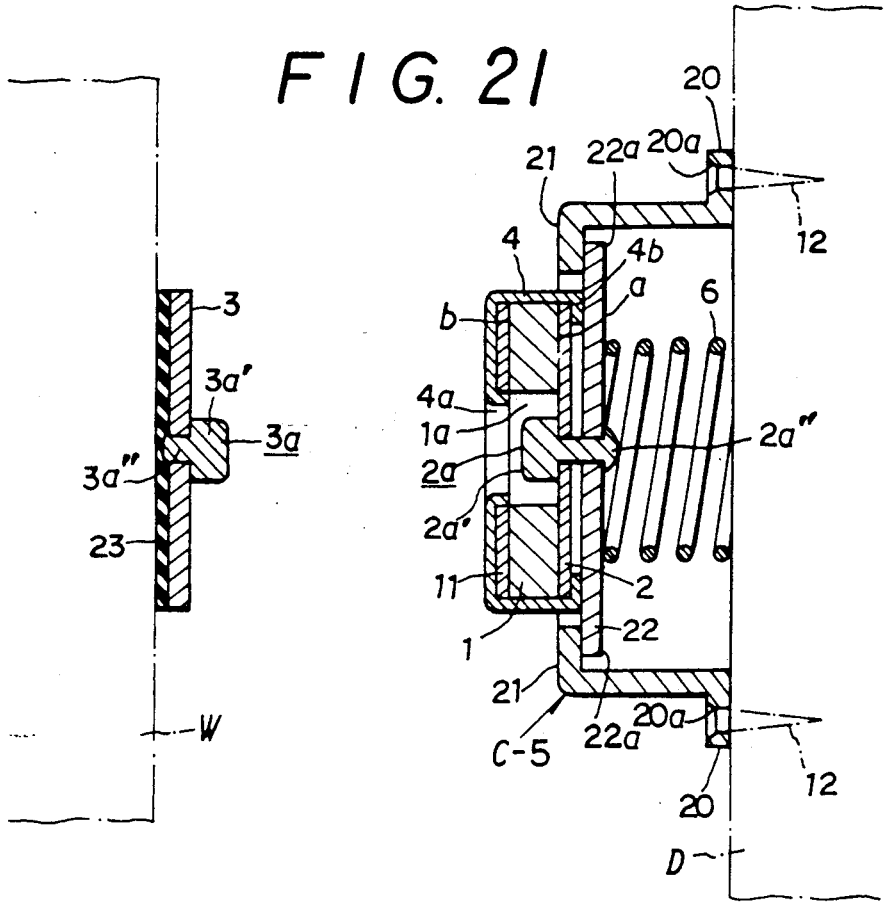
Figure 22:
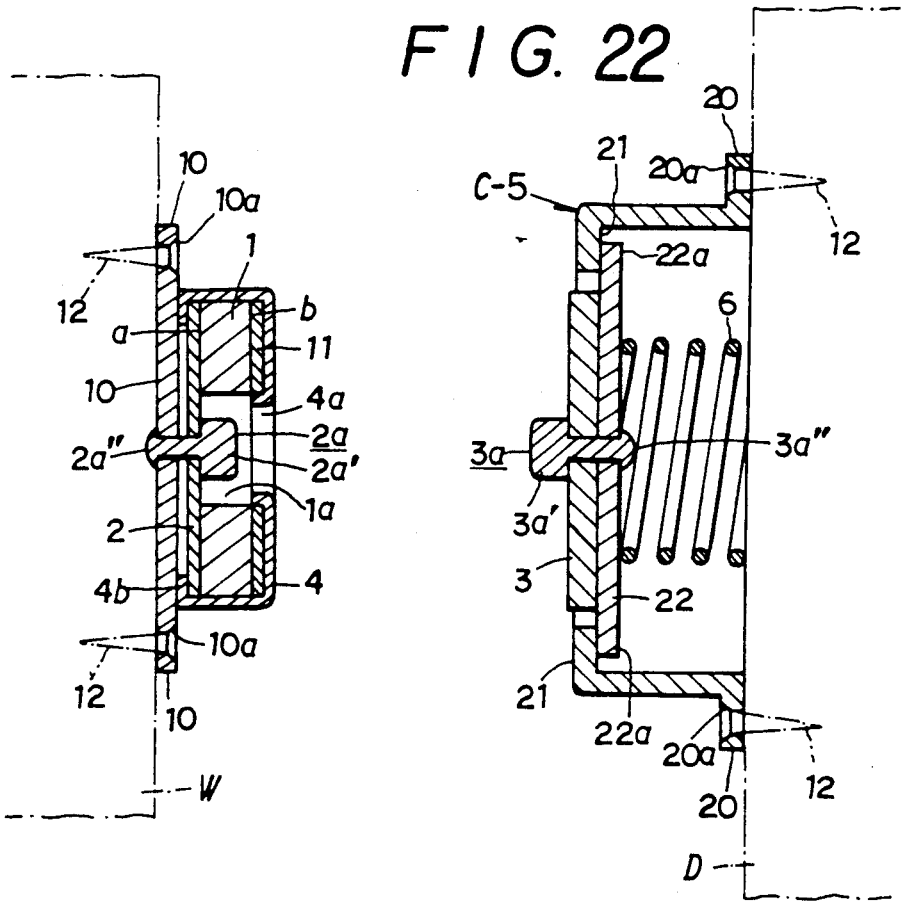

The attached drawings show some of the typical examples of the present invention. FIG. 1 shows a first embodiment of the present door stopper invention in cross section. FIG. 2 is a perspective view of said door stopper broken down into parts. FIG. 3 shows another embodiment of the door stopper of which an attracting member A and an attracted member B are depicted in cross section. FIGS. 4 through 6 respectively show embodiments of the attracted member B in cross section. FIGS. 7 through 14 respectively show the embodiments of the attracting member A in cross section. FIG. 15 shows another embodiment of the present door stopper invention where the attracting member A and the attracted member B are placed in arrangement reverse to that of FIG. 1. FIG. 16 shows yet another embodiment of the present door stopper invention where a bent pipe-like member is attached to the attracting member A and shown in cross section. FIG. 17 is a perspective view of the door stopper shown in FIG. 16. FIG. 18 is another embodiment of the present door stopper invention where a straight pipe-like member is attached to the attracting member A and shown in cross section. FIG. 19 is a perspective view of the door stopper shown in FIG. 18. FIG. 20 is a cross sectional view of yet another embodiment of the present door stopper invention where a straight pipe-like member is attached to the attracting member A without a coil spring. FIG. 21 is a cross sectional view of still another embodiment where a part of the attracting member A is placed inside a cylindrical member with a flange and supported resiliently by a spring. FIG. 22 shows a cross sectional view of the cylindrical member shown in FIG. 21 supporting a spring and attracted member B, which in its turn is attracted by an attracted member A mounted on a wall, etc.

The door stopper shown in FIGS. 1 and 2 comprises a fixing member C-1 consisting of a bent plate 5 attached to the top of a door D by a screw or nail 12 through mounting hole 5*b*, an attracting member A mounted on the fixing member C-1, and an attracted member B fixed onto the wall W, etc. to be attracted to the member A. When the door D is opened and pushed toward the wall W, etc., the member B on the wall W, etc. is attracted to the member A on the side of the door D and keeps the door D open. Although not shown, the fixing member C-1 may be mounted on the side of the wall W, etc. and the attracted member B may be provided on the side of the door D.

The member A used herein comprises an annular shaped permanent magnet 1 with a hole la bored from one magnetic pole a to the other magnetic pole b, a non-magnetic case 4 with a hole 4*a* on its bottom connecting with the hole 1*a* of the permanent magnet 1, a ferromagnetic plate 2 fixed to the magnetic pole surface a of the permanent magnet 1 on the side not covered by the case 4 by a catch 4*b* of the case 4, and a rod 2*a* comprising a thick ferromagnetic rod portion 2*a'* projecting inside the hole 1*a* of the permanent magnet 1 on the ferromagnetic plate 2 by passing the thin rod portion 2*a''* of rod 2*a* through the hole on the ferromagnetic plate 2 from the side of the hole 1*a* of the permanent magnet 1.

At least the thick rod portion 2*a'* of the rod 2*a* is made of ferromagnetic material to thereby form a magnetic path of the magnetic pole a of the permanent magnet 1 together with the ferromagnetic plate 2. The end of the thin rod portion 2*a''* of the rod 2*a* may be made of non-magnetic material. Although not shown in the drawings, the thick rod portion 2*a'* may be attached to the side of the ferromagnetic plate 2 facing magnet 1, thick rod portion 2*a'* and may be made of different material mounted on the opposing side.

The member B to be attracted to such an attracting member A comprises a ferromagnetic plate 3 attracted to the permanent magnet 1, a rod 3*a* of which a thin rod portion 3*a''* is projected through a hole on the ferromagnetic plate 3 and its thick rod portion 3*a'* rests on the plate 3, and a mounting plate 10 comprised mainly of a non-magnetic material. The thin rod portion 3*a''* of the rod 3*a* is inserted through the holes of the ferromagnetic plate 3 and the mounting plate 10, and the projected portion is caulked to tightly fix the plates 3 and 10 in an integral fashion. At least the thick rod portion 3*a'* of the rod 3*a* is made of a ferromagnetic material to thereby form a magnetic path on the side of the magnetic pole b of the permanent magnet 1 together with the ferromagnetic plate 3 attracted to the permanent magnet 1 of the attracting member A.

The fixing member C-1 consists of an oblong metal plate 5 one end of which is bent substantially perpendicular and is denoted as a plate member 5'. The fixing member C-1 is fixed to the top of the door extending substantially horizontally therefrom so that the plate member 5' will assume a parallel relation with the surface of the door D. For fixing the member C-1 to the top of the door D stably, a plate member 5'' closely adhering to the top of the door D is provided on the other end of the plate 5 via a bent part 5*c* adjacent to the side of the door D and fixed by a screw, nail, etc. (12).

The thin rod portion 2*a''* of the rod 2*a* of the attracting member A is inserted through a large hole 5*a* of the plate member 5'' and provided with a spring 6. A washer 8 is inserted over the rod portion 2*a''* extending on the side of the door D from the hole 5*a*, and tightened with a nut 9 to thereby attach the member A to the plate member 5' in a freely swingable manner. It is also recommendable to provide a washer 7 on the side of the plate member 5' mounted with the spring 6 in order to securely fix the spring 6 between the ferromagnetic plate 2 and the plate member 5'.

The member A thus fixed on the fixing member C-1 is mounted resiliently with the spring 6 in the direction of the member B which is mounted on the wall W, etc. extending from the plate member 5' so as to allow the member A to swing in all directions with respect to the thin rod portion 2*a''* of the rod 2*a*.

Although not shown, the member A may be fixed to the plate member 5' by welding a nut-like member to the thin rod portion 2*a''* without using the washer 8 or the nut 9, or it may be fixed by caulking. The end of the thin rod portion 2*a''* may be crushed and spread so that it will not slip off the hole 5*a* of the plate member 5' or of the washer 8.

The member A on the door D attracts the member B fixed on the wall W, etc. with which the member A contacts when the door D is open so that the door D will be maintained in an open state. The member B may be fixed on the wall W, etc. by a nail 12 etc. by using the hole 10*a* of the mounting plate 10. Although not shown, it may be fixed by using an adhesive or a double faced adhesive sheet.

In the door stopper thus constructed, the member A and the member B are attracted with a buffering action of the spring 6 so that the door stopper is not damaged by the impact of attraction. Even when the member A and the member B are in displacement with respect to each other, the member A is swung about the rod portion 2*a''* so that the rod portion 3*a'* of the member B is guided into the hole 1*a* of the member A. As the members A and B are attracted to each other resiliently via the spring 6 in the above mentioned manner, the door stopper is securely attracted even when shocks are applied thereon.

As the rod portions 2*a'*, 3*a'* are attracted inside the hole 1*a* of the permanent magnet 1, the ferromagnetic plate 2, the rod portions 2*a'*, 3*a'* and the ferromagnetic plate 3 form a closed magnetic circuit, and the attraction is quite intense compared to other types of stoppers merely using a permanent magnet plate.

The length of the fixing member C-1 can be set arbitrarily; if there is a considerable space between the door D and the wall W, etc., the length may be adapted to such a space. Thus, the present stopper invention is characterized by its flexibility.

The members A and B shown in FIG. 3 is an alternative embodiment of the attracting member A and the attracted member B used for the present door stopper invention.

The member A shown in FIG. 3 has a construction wherein the rod 2*a* has a thin rod portion 2*a''* but not a thick rod portion 2*a'* so that the thick rod portion 3*a'* of the member B is directly attracted to the ferromagnetic plate 2 inside the hole 1*a* of the member A. The rod 2*a* does not necessarily have to be ferromagnetic, but it should preferably be made of a ferromagnetic material in order that the rod portion 3*a'* and the ferromagnetic plate 2 may form an excellent closed magnetic circuit. When the rod portion 3*a'* is thus inserted deep into the hole 1*a* of the member A, the attraction of the member A and the member B is not impaired. It is a stable and secure attraction.

As shown in FIGS. 4 through 6, construction of the the member B may vary depending on the shape of the attracting surface of the member A and the means to mount the member B on the wall W, etc. The member B shown in FIG. 5 is the most typical example wherein a ferromagnetic plate 3 is mounted with a thin rod portion 3a'' through a hole thereon so that the thick rod portion 3a' of the rod 3a rests on the ferromagnetic plate 3, and the inserted rod portion 3a'' is caulked with the plate 3. The member B is fixed to the wall W, etc. by nails etc. through the hole 3b or adhered with an adhesive or a double faced adhesive sheet.

The member B shown in FIG. 5 consists of a ferromagnetic plate 3 attached with a fixing plate 10, a thick rod portion 3a'' of a rod 3a inserted through a hole on the plates 3 and 10 and caulked in an integral fashion. Similarly to the above embodiment, the member is nailed via the hole 10a or adhered, etc. to the wall W, etc. The member shown in FIG. 6 consists of a ferromagnetic plate 3, and a large diameter rod 3a' press-formed integrally, and a fixing member made up of stepped ferromagnetic plate 3 and provided with a hole 3b. It is fixed onto the wall W, the door D, etc. similarly to the member B shown in FIGS. 4 and 5.

Figure 7:
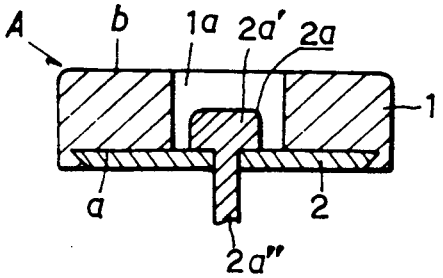
Figure 8:
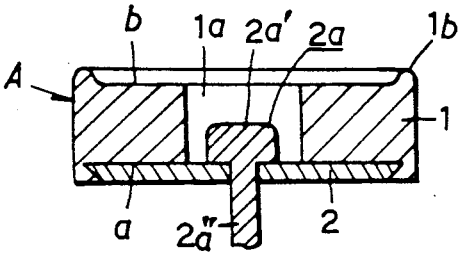

The member A shown in FIGS. 7 and 8 uses a plastic magnet 1 and does not require a case 4. The ferromagnetic plate 2 may be moulded with the plastic magnet 1 or attached thereto with an adhesive. The member A shown in FIG. 8 has a magnetic pole b with a dented surface on the attracting side to allow the ferromagnetic plate 3 of the member B into the dent portion, and the upright edge 1b on its periphery effectively shields the magnetism in part.

Figure 9:
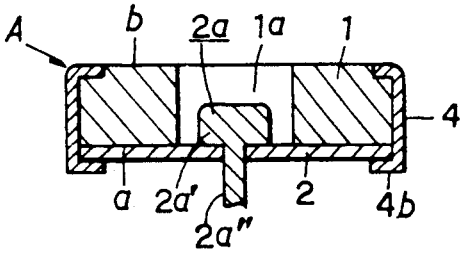
Figure 10:
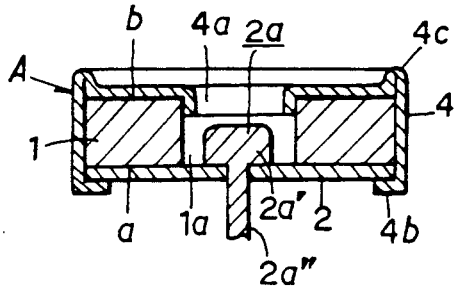
Figure 11:
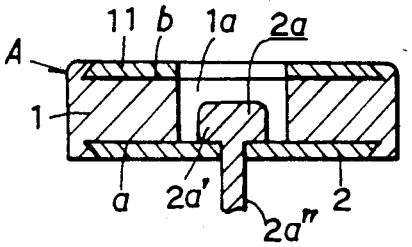

FIGS. 9 and 10 show embodiments for the case 4 which covers the permanent magnet 1. In FIG. 9, the member A allows the magnetic pole surface b corresponding to the attracting surface to contact the member B directly without the case to thereby enhance the attraction. In FIG. 11, the member A raises the case 4 on the periphery of the attraction surface to form a ridge 4c. The ferromagnetic plate 3 of the member B is fitted in the dent portion inside the ridge 4c, and the ridge 4c acts to prevent destruction of magnetic recordings such as that on a banking card.

FIGS. 12 through 15 show the member A which is structured to effectively achieve the magnetic shield effect. In the member A shown in FIGS. 11 through 14, a plate 11 is provided on the magnetic pole surface b of the permanent magnet 1. The plate 11 may be a shield plate of a ferromagnetic material or a reinforcement plate of plastic, cardboard, etc. When the plate 11 is used as a ferromagnetic shield plate, the magnetic flux of the permanent magnet 1 forms a magnetic path inside the shield plate 11 to thereby prevent magnetic leaks and destruction of magnetic records on banking cards, etc. when they are brought close to the member A. When the plate 11 is used as a reinforcement plate, the permanent magnet 1 does not become broken when the member A collides with the member B. When the case 4 is formed with a thin plate, the plate 11 acting as a reinforcement on the surface of the permanent magnet 1 prevents the surface roughness thereof from damaging the case 4.

Figure 12:
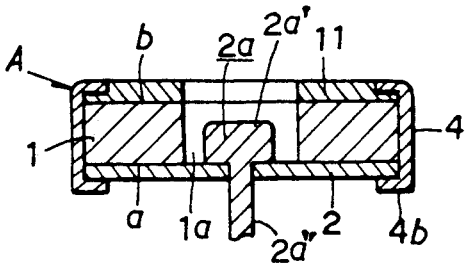

FIG. 11 shows an attracting member A moulded with a plate 11 for either shielding or reinforcing on the side of magnetic pole surface b of the permanent magnet 1. FIG. 12 shows a member A mounted with a plate 11 for either shielding or reinforcing with a cylindrical case 4. FIG. 13 shows a member A completely covered by a non-magnetic case 4 moulded with a plate 11 for shielding or reinforcing. FIG. 14 shows a member A constructed similarly as that shown in FIG. 13 wherein the case 4 is given a ridge 4c at the periphery of the attracting surface of the member A formed in FIG. 13 so as to enhance the shielding or reinforcing effects of the plate 11.

The member A shown in FIGS. 7 through 14 is used by mounting the same on the side of the door D or on the side of the wall W opposite to the door D. The remaining construction of the member A is similar to that shown in FIGS. 1 and 2 and the same numbers are used for the parts explained above. The member A shown in FIGS. 7 through 14 is shown with the thick rod portion 2a' of the rod 2a coming midway of the hole 1a of the permanent magnet 1 to facilitate understanding. As shown in the embodiment of FIG. 3, the rod portion 2a' may extend beyond the hole 1a, or the rod portion 2a' may be omitted and the rod portion 3a' of the member B may be directly attracted to the ferromagnetic plate 2 of the member A.

In the door stopper shown in FIG. 15, the member B is attached to the fixing member C-1 provided on the door D and the member A is attached the wall W, etc. Different from the door stopper shown in FIGS. 1 and 2, the thin rod portion 3a'' of the rod 3a fixed to the ferromagnetic plate 3 is fixed to the plate 5' of the fixing member C-1 with a washer 8 and a nut 9 via a washer 7, and a spring 6 is placed between the washer 7 and the ferromagnetic plate 3 so as to make the ferromagnetic plate 3 swingable. The member A, on the other hand, is fixed on the wall W by a nail or screw 12 by inserting a thin rod portion 2a'' of the rod 2a through holes of the ferromagnetic plate 2 and the mounting plate 10, the end of said rod 2a'' being caulked with the mounting plate 10 in an integral fashion.

The door stopper shown in FIG. 15 has the same construction except that the members A and B are placed in positions reverse to those shown in FIGS. 1 and 2. Therefore, explanations on the parts explained with respect to FIGS. 1 and 2 are not given here and the same numbers are used to indicate the same parts. In the embodiment, the member A mounted on the wall W, etc. may be used for magnetically hanging keys, etc.

The door stopper shown in FIGS. 16 and 17 is fixed by a fixing member C-2 which is fixed on the floor, etc. mainly by a screw or nail 12. The fixing member C-2 is a pipe bent in an inverted L-form, and consists of a hollow member 13 extending in the horizontal direction and a hollow member 14 extending in the vertical direction connected together. The hollow member 13 is divided by a partition 15, and a member A is attacted to the partition 15 inside the thus-divided hollow member 13a on the opening side of the fixing member C-2. The hollow member 13a has a larger diameter than the hollow member 13 in order to allow swinging of the member A and to extend the plane for attraction.

Through a hole 15a on the partition 15 of the fixing member C-2 thus constructed is inserted a thick rod portion 2a'' of the rod 2a of the member A to fix the washer 8 and the nut 9, and a spring 6 is provided between the washer 7 and the ferromagnetic plate 2 mounted on the partition 15 to thereby make the member A swingable.

After mounting the member A on the partition 15 in the above mentioned manner, a hole 13' of the hollow portion 13 open to the outside is covered by a cap 16. It is also possible to construct a fixing member C-2 by inserting the pipe having a partition 15 on the horizontal side of the pipe in an inverted L shape. In this case, there is no need to bore the hole 13'.

The member A is mounted in the hollow member 13*a* with a space 17 to allow swinging of the member A and projects slightly outside the hollow member 13*a*. It is not preferable to provide the member A well inside the hollow portion 13*a* because it makes attraction with the member B difficult. In this embodiment, the construction of the members A and B are the same as those shown in FIGS. 1 and 2 except that the member A having a plate 11 is shown as a typical example of the attracting member A. Therefore, explanations for the portions already explained are not given here and the same numbers are given to the same parts.

As shown in FIG. 15, it is possible to fix the member B to the fixing member C-2 using a spring 6 in a freely swinging manner and the member A on the door D to achieve the same effects.

The door stopper shown in FIGS. 18 and 19 uses a relatively long hollow pipe for the fixing member C-3 to fix the member A in a freely swinging manner. The fixing member C-3 has a larger diameter bottom and is fixed onto the door D by a nail or screw, and has a partition wall 15 between the hollow portions 13*a* and 13. The member A is fixed to the partition wall 15 inside the hollow portion 13*a* in a manner similar to that shown in FIGS. 16 and 17 to attract the member B. Since this fixing member C-3 is a straight pipe, it is easy to form the partition 15. Such a straight pipe is useful when there is a distance between the door D and the wall W for offering a door stopper without damaging its appearance.

The fixing member C-3 with the member A may be provided on the wall W, etc. and the member B on the door D. Alternatively, the member B may be fixed to the fixing member C-3 and the member A on the side opposite thereto. The door stopper shown in FIGS. 18 and 19 resemble the stopper shown in FIGS. 16 and 17, and the explanation of the portions explained already is omitted and the same numbers are used for the same portions.

In the door stopper shown in FIG. 20, the member A is fixed to a pipe-like fixing member C-4 without a spring 6. This fixing member C-4 is a perfectly straight pipe, and is provided with a female screw 18 on one end. It is screwed to a base 19 formed like a male screw rod and attached to the door D with a nail, screw, etc. 12. Thus, the fixing member C-4 extends straight from the door D.

On the other end of the thus constructed fixing member C-4 is provided a partition 15 to divide the pipe into a hollow member 13 and another hollow member 13*a*. The member A is placed inside the hollow member 13*a*, a thin rod portion 2*a*″ of the rod 2*a* of the member A is extended to the inside of the hollow member 13 through a hole 15*a* of the partition 15, and the rod is stopped by a washer 8 and a nut 9 from slipping out of the hole 15*a*. In this embodiment, a ferromagnetic plate 2 and the thick rod portion 2*a*′ is press-formed in one piece, and the thin rod portion 2*a*″ is welded thereto. The member B is directly mounted on the wall W, etc. by threading the thin rod portion 3*a*″ of the rod 3*a* of the ferromagnetic plate 3. Thus, the member A is made freely swingable as the thin rod portion 2*a*″ is inserted into the larger hole 15*a* inside the hollow portion 13*a*. Similar to the above mentioned embodiments, there may be provided a member B on the side of the fixing member C-4. The fixing member C-4 may also be provided on the side of the wall W.

Since the other portions of this embodiment are the same as those shown in FIGS. 16 through 19, their explanation is omitted and the same numbers are given to the same parts.

The door stopper shown in FIGS. 21 and 22 enables swinging of the members A and B without using the thin rod portions 2″, 3*a*″ of the rods 2*a* and 3*a*.

In the door stopper shown in FIG. 21, a flange 20 facing outside is provided on one end of the cylindrical fixing member C-5, and a flange 21 facing inside is provided on the other side thereof. The stopper is fixed by a screw or nail 12 to the door D through holes 20*a* of the flange 20. There is provided a spring 6 inside the fixing member C-5 thus fixed to the door D to thereby fix the member A. The member A is inserted with a thin rod portion 2*a*″ of the rod 2*a* through a hole of a mounting plate 22 provided on the ferromagnetic plate 2, and the end of the thin rod portion 2*a*″ is caulked with the mounting plate 22 integrally. The plate 22 has a larger diameter than the member A and is provided so as to form a flange member 22*a* on the non-attracting side of the member A. The member A inserted through the larger opening of the fixing member C-5 is extended outside the flange 21, the flange member 22*a* is engaged with the flange 21, the spring 6 is placed therein, and the fixing member C-5 is fixed onto the door D by a nail, screw or the like 12. Thus, the member A is made swingable inside the fixing member C-5.

The member B to be fixed to the wall W, etc. is attached by a double faced adhesive sheet 23.

Although the door stopper mentioned above is constructed with the fixing member C-5 fixed on the door D, the member C-5 may be provided on the side of the wall W, etc. While the flange member 22*a* to be engaged with the flange 21 consists of a mounting plate 22, the flange 22*a* may be formed by other means on the member A.

The door stopper shown in FIG. 22 is the same as that of FIG. 21 except that the member B is fixed onto the fixing member C-5. The member B consists of a ferromagnetic plate 3, a mounting plate 22, a rod 3*a* inserted through a larger opening, and a spring 6 which is forced with a flange 21 abuttingly engaging a flange member 22*a* of the mounting plate 22. The member C-5 is fixed by a nail, screw, etc. on the surface of the door D.

The member B thus becomes fixed to the fixing member C-5 in a freely swinging manner and is attracted by the member A by following its movement. The member B may be provided with a ferromagnetic plate 3 alone without the mounting plate 22 and the periphery of the ferromagnetic plate 3 may be directly engaged abuttingly with the flange 21. The fixing member C-5 provided on the side of the door D may be provided on the side of the wall W, etc.

Explanation of the parts of the door stopper shown in FIGS. 21 and 22 which have already been explained is omitted, and the same numbers are given to the same parts.

Although typical embodiments of the present invention have been explained so far, the scope of the present invention extends to other embodiments which are in keeping with the objects of the invention. For instance, the member A and the member B may have spherical surfaces to be engaged with and contact each other, or fixing members C other than those shown in the above embodiments may be used.

What we claim is:

1. An apparatus for stopping and holding a door open, comprising:

(a) a first ferromagnetic plate means comprising:

a first ferromagnetic plate having a hole in its center; and a first ferromagnetic projection being positioned through said hole;

(b) a magnetic holding means comprising:

a disk-like permanent magnet having a hole through its center;

a second disc-like ferromagnetic plate having a hole being positioned against a first pole of said permanent magnet;

means for fixedly holding said permanent magnet against said second ferromagnetic plate; and a second ferromagnetic projection being positioned through said holes of said magnetic holding means;

(c) a first mounting mans for mounting one of said first plate means and said magnetic holding means on one of said door and a co-operating fixed surface;

(d) a second mounting means for mounting the other of said first plate means and said magnetic holding means on the other of said door and said fixed surface; and (e) a biasing means for biasing one of said magnetic holding means and said first plate on said second mounting means away from the respective door and cooperating fixed surface, whereby when said door is moved to its open position, a second pole of said permanent magnet being positioned and aligned with said first plate means to complete a magnetic circuit to hold said door open and said first projection engaging said second projection within said hole of said permanent magnet to enhance said magnetic circuit.

2. An apparatus for stopping and holding a door as recited in claim 7, wherein when said permanent magnet is aligned and substantially flat against said first ferromagnetic plate, said first and second projections extend into said center of said magnet and establish a further ferromagnetic path between said first and said second ferromagnetic plates.

3. An apparatus for stopping and holding a door as recited in claim 2, wherein said first projection includes a first enlarged head formed at one end thereof, said first head extends outward toward said second pole of said magnet, such that when said magnet contacts said first ferromagnetic plate, said first head extends a first predetermined distance into said center of said magnet.

4. An apparatus for stopping and holding a door open as recited in claim 2, wherein said second projection includes a second enlarged head at one end thereof, said second head projects a second predetermined distance into said center of said permanent magnet.

5. An apparatus for stopping and holding a door open as recited in one of claims 2–4 or 1, wherein said first ferromagnetic plate is attached to said second mounting means by a shock absorbing mounting means which includes said biasing means comprising a spring, such that when said first ferromagnetic plate contacts said magnetic holding means, said spring deflects to thereby shock absorbingly stop said door.

6. An apparatus for stopping and holding a door open as recited in one of claims 2–4 or 1, wherein said magnetic holding means is attached to said second mounting means by a shock absorbing mounting means which includes said biasing means comprising a spring, such that when said first ferromagnetic plate contact said magnetic holding means said spring deflects to thereby shock absorbingly stop said door.

7. An apparatus for stopping and holding a door open as recited in one of claims 2–4 or 1, wherein said second mounting means includes an L-shaped bracket plate.

8. An apparatus for stopping and holding a door open as recited in one of claims 2–4 or 1, wherein said second mounting means includes an inverted L shaped pipe member which has one end attached to said fixed surface and has a hollow portion in its other end adapted to accommodate said magnetic holding means therein.

9. An apparatus for stopping and holding a door open as recited in one of claims 2–4 or 1, wherein said second mounting means includes a straight pipe member attached at one end to said fixed surface and has a hollow portion at its other end adapted to accommodate said magnetic holding means therein.

10. An apparatus for stopping and holding a door open as recited in one of claims 2–4 or 1, wherein said magnetic holding means further includes a protective cover such that when said magnetic holding means is flat against said first ferromagnetic plate said cover is between said first plate and said magnetic holding means.

11. An apparatus for stopping and holding a door open, comprising:

a ferromagnetic plate means having a first ferromagnetic plate with means for positioning a first ferromagnetic projection therewith;

a magnetic field generating means having a second ferromagnetic plate positioned against a first pole of said magnetic field generating means and means for positioning a second ferromagnetic projection therewith;

a first mounting means for mounting one of said first plate means and said magnetic field generating means on one of said door and a co-operating fixed surface;

a second mounting means for mounting the other of said first plate means and said magnetic holding means on the other of said door and said fixed surface; and a biasing means for biasing one of said magnetic field generating means and said first plate mans in said second mounting means away from the respective door and co-operating fixed surface, whereby one of said first plate and projection and second plate and projection in said second mounting means being movable together when longitudinal force is applied by said door.

* * * * *